United States Patent [19]

Cross et al.

[11] Patent Number: 4,865,688

[45] Date of Patent: Sep. 12, 1989

[54] PROCESS FOR PREPARING A WEB WITH AN ABRASION RESISTANT RESILIENT BACKING

[75] Inventors: Jimmy D. Cross, Signal Mountain, Tenn.; Landon Smith, Rossville, Ga.

[73] Assignee: BASF Aktiengesellschaft, Ludwigshafen, Fed. Rep. of Germany

[21] Appl. No.: 149,670

[22] Filed: Jan. 28, 1988

[51] Int. Cl.[4] ..... B32B 31/20; B32B 5/18

[52] U.S. Cl. ..... 156/78; 156/209; 156/324; 264/46.3; 264/48; 264/50; 428/95

[58] Field of Search ..... 156/78, 209, 220, 324; 264/46.3, 48, 50; 428/95

[56] References Cited

U.S. PATENT DOCUMENTS 3,255,140 6/1966 Sinn et al. .
3,255,141 6/1966 Sinn et al. .
3,285,796 11/1966 McElhinney .
3,513,046 5/1970 Westfield .
3,904,558 9/1975 Graham et al. .
4,214,053 7/1980 Porter .
4,305,986 12/1981 Hartmann et al. ..... 428/95
4,595,617 6/1986 Bogdany ..... 428/95

FOREIGN PATENT DOCUMENTS 1284064 8/1972 United Kingdom .
1520827 8/1978 United Kingdom .

*Primary Examiner*—Robert A. Dawson
*Attorney, Agent, or Firm*—Bruce E. Harang

[57] ABSTRACT

Carpet, or carpet tile having a tough resilient backing may be prepared by incorporating a fleece (6) into a foam backing on a carpet. The foam (5) is applied to the back of a carpet and the fleece (6) is overlaid and the foam and fleece are crushed together and gelled preferably using a drum laminator (10) then dried in a conventional oven (13). The resulting carpet may be cut into carpet tiles. The carpet or tile has lay flat properties and good abrasion resistance.

16 Claims, 1 Drawing Sheet

PROCESS FOR PREPARING A WEB WITH AN ABRASION RESISTANT RESILIENT BACKING

FIELD OF THE INVENTION

The present invention relates to cushion backed carpet. More particularly, the present invention relates to cushion backed carpet having a dense abrasion resistant, dimensionally stable cushion backing.

BACKGROUND OF THE INVENTION

Foam backed carpet has been known for a number of years. Generally, the carpet comprises a backing sheet, such as polypropylene, through which a yarn is sewn. The loops of yarn on the carpet may be cut or uncut after it is sewn through the backing sheet. Then a precoat is applied to the back of the carpet. Typically, such a coating is a compound of a carboxylated styrene-butadiene latex. Suitable precoat procedures are described, for example, in U.S. Pat. No. 3,513,046, issued to Polymer Corporation Limited, the text of which is hereby incorporated by reference.

After the precoat is applied, a backing is applied to the carpet. The backing may be jute, or it may be a woven or non-woven material such as a polyolefin scrim. The backing may also be a foamed latex compound. The foamed compounds are generally made with a styrene-butadiene latex and are fairly highly filled. This may lead to problems such as foam breakdown or foam tearing. These problems are accentuated in recent trends towards carpet tile.

U.S. Pat. No. 3,285,796, issued Nov. 15, 1966, assigned to Cabin Crafts Inc., Dalton, Ga., describes a process in which the back of a carpet is napped. The nap is then coated with a latex. This provides a carpet with a resilient backing. The napping operation is an additional step in the process and may weaken the pile used in the manufacture of the carpet.

There is a need for a simple process to produce a dense, abrasion resistant, dimensionally stable foam backed carpet. The present invention seeks to address this need.

SUMMARY OF THE INVENTION

The present invention provides a process for preparing a flexible web backed with a dense abrasion resistant, dimensionally stable foam comprising:

(a) applying substantially uniformly over a planar surface of said web a first layer of material selected from the group consisting of:
  (i) a frothed gellable compound having a density of from 200–1000 g/l based on a latex of a rubbery polymer; and
  (ii) a uniform non-woven fleece having a thickness about 0.6 to 7.6 cm and weighing from 8 to 210 g/m$^2$;

(b) applying substantially uniformly over said first layer, a second layer of material which is the material not used for the first layer; provided that the compound saturates the fleece and the surface of the web and the dry weight of the compound and web is from 16 to 2100 g/m$^2$;

(c) compressing said web and said layers to not less than one third of the original thickness of the web and the layers;

(d) gelling said compound before said fleece significantly expands; and (e) drying and vulcanizing said backing.

DETAILED DESCRIPTION

Figure 1:
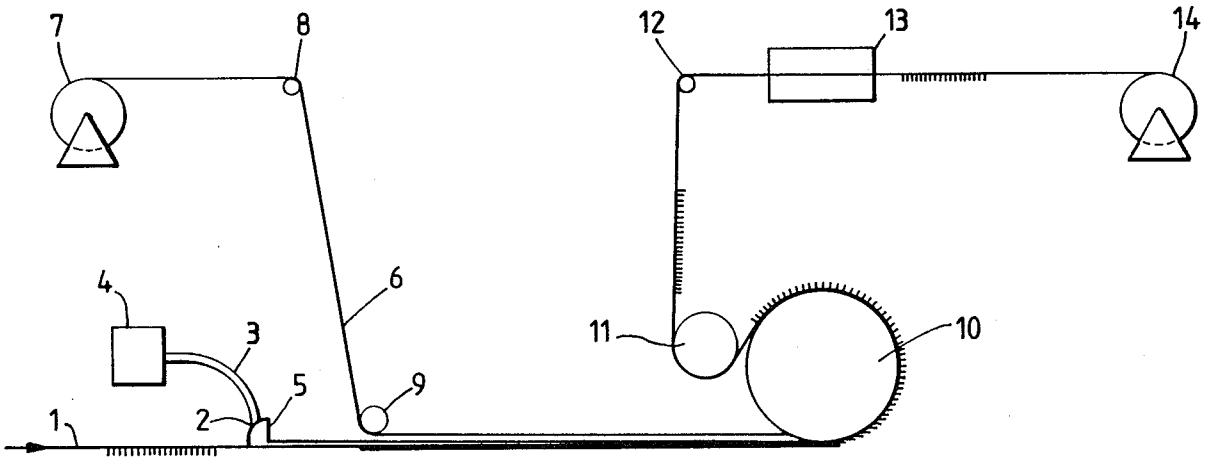

In the process of the present invention, the compound is a gellable compound of a latex of a rubbery polymer. As used in this specification the term gellable compound means a compound which will undergo phase inversion and "set" under the action of a gelling agent. The compounds comprise a continuous aqueous phase and a discontinuous rubbery phase. On gellation, the rubbery phase becomes continuous and the aqueous phase becomes discontinuous. When the gelling agent(s) is a silicofluoride or a mixture of a bivalent metal ion-amine releasing agent, the surfactants used in the compound are those which at lower pH are significantly reduced in activity or become insoluble. Typically, these soaps are alkali or ammonium salts of long chain fatty acids, rosin acids or oils such as sodium stearate, palmitate, rosinate, and the like.

Suitable polymers for use in the present invention are styrene-butadiene type polymers and nitrile rubber type polymers, acrylate polymers, ethylene vinyl acetate polymers and blends of these polymers and their functional containing homologues, provided that latices of these polymers are gellable.

Suitable styrene-butadiene polymers comprise from 15 to 60, preferably 20 to 40, weight percent of a $C_{8-12}$ vinyl or vinylidene aromatic monomer which may be unsubstituted or substituted by a $C_{1-4}$ alkyl radical or a chlorine or bromine atom and from 85 to 40, preferably 80 to 60 weight percent of a $C_{4-6}$ conjugated diolefin which may be unsubstituted or substituted by a chlorine atom.

Preferred vinyl or vinylidene aromatic monomers are styrene and alpha-methyl styrene. Preferred conjugated diolefins include butadiene, isoprene and chloroprene.

Suitable nitrile rubbers comprise from 5 to 40, preferably from 15 to 40, weight percent of a $C_{3-8}$ alkenyl nitrile, and from 95 to 60, preferably from 85 to 60 weight percent of a $C_{4-6}$ conjugated diolyefin.

Suitable conjugated diolefins have been discussed above. Suitable nitriles include acrylontrile and methacrylonitrile.

Suitable acrylate polymers comprise from 70 to 100 weight percent of one or more $C_{1-8}$ alkyl and hydroxyalkyl esters of $C_{3-6}$ ethylenically unsaturated carboxylic acids and up to 30 weight percent of a $C_{8-12}$ vinyl or vinylidene aromatic monomer which may be unsubstituted or substituted by a $C_{1-4}$ alkyl radical or a chlorine atom. Suitable esters include methyl, ethyl, propyl, butyl, and hydroxy ethyl, acrylate and methacrylate. Suitable vinyl aromatic monomers have been discussed above.

Suitable ethylene vinyl acetate type polymers comprises 5 to 40 weight percent of $C_{2-3}$ olefin and 95 to 60 weight percent of one or more monomers selected from the group consisting of $C_{2-8}$ alkenyl or hydroxy alkenyl esters of $C_{1-8}$ unsaturated carboxylic acids and $C_{1-8}$ alkyl and hydroxyalkyl esters of $C_{3-6}$ ethylenically unsaturated carboxylic acids.

Useful olefins include ethylene and propylene. Suitable alkenyl and hydroxyalkenyl esters of saturated carboxylic acids include vinyl acetate. Useful alkyl and hydroxyalkyl esters of $C_{3-6}$ ethylenically unsaturated carboxylic acids have been discussed above.

The above polymers may contain small amounts of preferably less than 5, most preferably from 0.5 to 3 weight percent of one or more additional functional monomers. Useful functional monomers include:

$C_{3-6}$ ethylenically unsaturated aldehydes;

$C_{1-8}$ alkyl or hydroxyalkyl esters of $C_{3-6}$ ethylenically unsaturated carboxylic acids; and amides of $C_{3-6}$ ethylenically unsaturated carboxylic acids, which amides may be unsubstituted or substituted at the nitrogen atom by up to two radicals selected from the group consisting of $C_{1-4}$ alkyl and hydroxyalkyl radicals.

$C_{3-6}$ ethylenically unsaturated carboxylic acids.

These polymers are generally available as latices having a solids content from 50 to 75 weight percent.

The latex may be uncompounded or compounded with up to 150, preferably about 80 to 120 parts by weight per 100 parts by weight of polymer of a particulate filler. The particulate filler may comprise one or more conventional fillers such as calcium carbonate, talc, clay, aluminum trihydrate and barytes. Preferably, the filler is a dense material such as barytes.

The compound will also contain a gelling agent. For gelling the above polymers which may contain carboxylated polymers, there are a number of useful agents or combinations of agents.

The polymer may be gelled with a silicon polyether of the formula:

$$R'(OC_nH_{2n}) \times OOCNH-A-CH_2-CH_2)_a(R)_bSiO_{\frac{4-a-b}{2}}$$

wherein:

R is an organic radical, preferably $C_{1-4}$ most preferably methyl joined to the silicon through a silicon carbon linkage;

R′ is a $C_{1-7}$ preferably $C_4$ alkyl radical or a $C_{6-12}$ aryl radical;

A is a $C_{1-7}$ divalent hydrocarbon radical;

a has a value from 0.5 to 1, inclusive;

b has a value from 1.12 to 1.90 inclusive and the sum of a+b is from 2.02 to 2.40 inclusive;

n is an integer from 2 to 4 inclusive; and x is at least 5, preferably from 10 to 100.

These gelling agents may be used alone in amounts of at least 2, preferably 2 to 10 parts by weight per 100 parts by weight of polymer.

It is also known to use a combination comprising per 100 parts by weight of polymer from 0.05 to 1.0 parts by weight of such silicon ethers with from 4 to 20.0 parts by weight of an aromatic sulfonate emulsifier of the formula:

$$R-[A-SO_3]-M$$

wherein:

R is a $C_{8-20}$ alkyl or alkenyl radical;

A is a benzene ring; and

M is an alkali or alkaline earth metal, per 100 parts by weight of polymer.

Such carboxylated polymers may also be gelled with from 1 to 20 parts by weight per 100 parts by weight of polymer of a tertiary or quaternary amine of the formula:

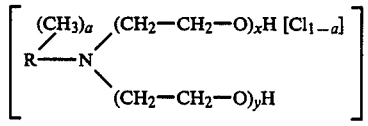

wherein:

a is 0 or 1 x and y are integers and the sum of x+y is from 5 to 30; and

R is a fatty acid radical.

The tertiary amines may be used alone or in combination with from 0.5 to 2, preferably 1 part of the above noted silicon polyether or from about 1 to 10 preferably 2.0 to 4.0 parts by weight of the above noted aromatic sulonate per 100 parts by dry weight of latex.

These types of gelling agents are described in a number of patents including British patent specifications Nos. 1,284,064 and 1,520,827 published Aug. 2, 1972 and Aug. 9, 1978 respectively, and U.S. Pat. Nos. 3,255,140 and 3,255,141 issued June 7, 1966.

When the polymer is non-carboxylated, and most preferably when the polymer is on SBR latex, the gelling agent may be a metal or ammonium silicofluoride, most commonly sodium, potassium, or ammonium silicofluoride. The silicofluorides are generally used in an amount from about 0.3 to about 8, preferably about 0.5 to 2.5 most preferably 0.5 to 2 parts by weight dry per 100 parts by weight of polymer in the compound. These gelling agents are referred to as "time delay" gelling agents. That is, they cause the compound to gel in a fairly short time after their addition. Typically, these gelling agents are added to the compound immediately prior to, during or shortly after foaming.

For non-carboxylated SBR latices, the gelling agent may be a system comprising ammonium and one or more bivalent metal ions. The bivalent metal ion is usually present in an amount from about 0.5 to 10, preferably 1 to 5, parts by weight per 100 parts by weight of polymer. Suitable bivalent metal ions include zinc and cadmium. Zinc is a preferred bivalent metal ion and it is generally present in the cure paste, to vulcanize the rubber. The second component in these types of gelling systems is a compound which releases ammonia, or ammonium ions. Suitable compounds include ammonium salts of $C_{1-6}$ carboxylic acids or inorganic acids such as ammonium acetate, ammonium chloride, ammonium sulfate, ammomium hydroxide and $C_{1-4}$ alkyl amines. The compound which releases ammonium ions is generally used in amounts to provide from about 0.1 to 6, preferably 0.3 to 4 parts by weight of ammonia or ammonium ions per 100 parts by weight of polymer.

These amine-bivalent metal ion binary gelling systems are sometimes referred to as "temperature dependent gelling agents". At temperatures less than about 30° C., the gelling reaction is very slow. Thus, the gelling agents may be added to the compound prior to foaming, provided the compound will not be exposed to high temperatures for long.

When using either of the above gelling agents, and particularly in the case of silicofluoride gelling agents, it may be desirable to add chemicals to the compound which increases the tolerance of the compound to gelling.

These chemicals, in effect, broaden the conditions under which the compound sets. This is useful to improve characteristics such as the foam structure or the surface or skin on the foam. These chemicals include ammonium sulfamate, $C_{1-4}$ alkyl amine sulfamates and $C_{1-4}$ alkyl amine sulfates. These agents may be used in amounts up to 6, preferably from 0.1 to 4.0 parts by weight per 100 parts by weight of polymer. The use of such compounds is disclosed in U.S. Pat. No. 3,904,558, issued Sept. 9, 1975, assigned to Polysar Limited, and U.S. Pat. No. 4,214,053, issued July 22, 1980, assigned to Polysar International S.A., the disclosures of which are hereby incorporated by reference.

The process of the present invention will now be described in conjunction with FIG. 1 which is a schematic diagram of the one embodiment of the process.

Carpet 1, preferably pre-backed is fed to a coating station. A frothed compound 2 is delivered via a hose 3 from a foaming machine 4, such as an Oaks foamer (Trademark). The carpet passes beneath a doctor blade 5 and is coated with foamed compound. A fleece 6, is delivered from an unwind stand 7, over guide roller 8. In this particular embodiment, guid roll 9, lays the web on top of the foam but does not press it into the foam. The carpet, foam and web, then passes around at least a portion of the circumference of a hot drum laminator 10. As the carpet, foam and fleece, pass around the drum laminator, the fleece is compressed into the foam and the foam wets the back of the carpet. The heat from the drum 10, gels the latex. The drum laminator may be used to dry and vulcanize the foam, provided that the drum diameter is large enough. If the diameter is not large enough, a suitable secondary drying and vulcanizing means may be used such as hot air ovens or dielectric heating. The carpet and attached web then passes around roll 11, which maintains the tension of the carpet. The carpet passes over guide roll 12 and through an oven 13, where the foam is dried, and vulcanized. The carpet then is wound up on a wind up stand 14.

The carpet may be a conventional carpet, typically comprising a polyolefin scrim or a jute scrim, through which a natural or synthetic fiber, selected from the group consisting of polyamide fibers, such as Nylon 6, or Nylon 66, (Trademark), polyester fibers and natural fibers such as wool. Preferably, the carpet will have been coated with a backing coat to hold the fiber in place. Typically, the first coat is a compound based on a carboxylated-SBR or possibly an ethylene-vinyl acetate polymer, although other polymers might be used. The precoat may contain up to about 1200 parts of filler per 100 parts of polymer and is usually applied at low coat weights. A suitable precoat process is described in U.S. Pat. No. 3,513,046, issued May 19, 1970, assigned to Polymer Corporation Limited.

In accordance with the embodiment of the invention shown in the drawing, the precoated carpet is then coated with a foamed compound. The compound composition has been discussed above. In addition to the above ingredients, the compound may contain an additional amount of soap such as an alkali metal salt, preferably sodium or potassium, of a long chain fatty acid, such as stearic acid, an oil such as palm oil or rosin acid. The amount of soap may be up to about 3, preferably not greater than 1 part by weight per 100 parts of polymer. Additionally, the compound may contain agents to build or reduce viscosity. Suitable viscosities are about 5,000 mPa.s as measured with a Brookfield viscometer, using a #5 spindle at 20 rpms.

The compound may be foamed to a wet density of from 200 to 1000 g/l. typically, the foam will have a wet density from about 300 to 900, most preferably from about 350 to 800 g/l. The density of the compound is controlled by foaming the compound in a conventional foaming apparatus such as an Oaks (Trademark) foamer 4.

The foam is provided to the back of the carpet to form a bank of foam 2, behind a distribution means such as a doctor blade 5 or some similar suitable device. The foam may be applied at a thickness up to 1.2 cm. preferably about 0.3 to 0.6 cm. The coat weight of the foam will vary depending on the thickness and density of the foam.

In the embodiment shown in FIG. 1, the fleece is applied over top of the foam. The present invention may also be practiced where the fleece is applied first and the foam is then applied over the top of the fleece. Generally, the fleece will be a light weight non-woven web, weighing from 4 to 42, preferably from about 6.5 to 15 g/m$^2$. The fleece may be made from natural or synthetic fibers selected from the group consisting of polyamide fibers, such as Nylon 6, and Nylon 66 (Trademark) polyesters, cellulose, regenerated cellulose such as Rayon (Trademark), amine fibers such as wool or silk and mineral fibers such as glass. The fleece may have a thickness from about 0.6 up to about 5 cm. Preferably, the fleece will be from about 0.6 to 3.8 cm. thick.

The carpet carrying the fleece and the foam is then subjected to compression to saturate the web with the foam and to wet the back of the carpet. The compressed carpet is then gelled. In the particular embodiment shown in FIG. 1, the compression and gelling steps are carried out by passing the carpet around a hot drum laminator 10. The hot drum latinator may be at a temperature of from 75 to 150, preferably not more than 125° C. In this step, the fleece is impregnated with the foam and the foam is gelled or set. The combined layer of fleece and foam may be compressed to a thickness as low as about 0.3 to 0.6 cm. The foam sets or gels so that the fleece will not spring back to its original thickness.

The carpet backed with the foam saturated web then is dried and vulcanized. Typically, the drying and vulcanization will take place in a hot air circulating oven. Typically, the air temperature may be from 120 to 165, preferably 135° C. for times up to about 20, preferably not more than 10, minutes. The temperatures, dwell time, and line speed for any specific carpet construction will vary slightly. One skilled in the art will be able to SO adjust temperatures and line speed to obtain the required vulcanization. The resulting product is then wound up on a wind-up stand.

In the description of the embodiment shown in FIG. 1, a hot drum laminator is used to compress the fleece and foam, and gel the resulting mass. Other devices may be used to obtain the same result. For example, the foam and fleece could pass beneath a crush roller and then into an oven to gel the fleece-foam mass. More preferably, if the foam bank is maintained behind a metering roll, the fleece could pass around the metering roll and be impregnated with foam and applied to the web in one step.

While the embodiment described in FIG. 1 refers to the use of carpet as the substrate, it is possible to use other substrates such as a woven textile fabric or an extruded sheet. Such a material would be suitable for use in a number of applications, including carpet underpadding.

In a further step, the resulting sheet material preferably carpet, may be cut using conventional means to produce squares of a lay-flat, tough, resilient material, preferably carpet tile.

EXAMPLES

The following examples are intended to illustrate the invention and are not intended to limit it.

In the following examples, parts are parts by weight, unless otherwise specified.

EXAMPLE I

A base compound was prepared as follows:

| | Dry | Wet |
|---|---|---|
| POLYSAR Latex 425 (S-B Latex with 31 percent bound styrene) | 100.0 | 141.64 |
| Potassium Oleate | 1.0 | 5.55 |
| Aluminum Trihydrate | 140. | 140. |
| Cure Paste | 9.9 | 18.9 |
| Water - to 80 percent solids | | |

Thickener - to 5,000 cps on a Brookfield viscometer - #50 spindle at 20 rpm.

The cure paste is a typical cure paste comprising on a dry weight basis the following:

| | |
|---|---|
| Sulfur | 1.65 |
| Zinc Oxide | 1.25 |
| Zinc diethyl dithiocarbanate | 1.00 |
| Zinc salt of mercaptobenzo diphenyl | 1.25 |
| Thiazole amine acetone reaction product (Aminox) | 0.45 |
| Antioxidant (Hindered phenol) | 0.30 |
| | 5.90 |

This is prepared as about a 52 percent solids dispersion.

To the base compound was added 1 part by dry weight per 100 parts of polymer of a 25 percent dispersion of sodium silicofluoride, and 0.5 parts by weight of a 66 percent solution of trimene base. The compound was foamed to a density of 250 g/l.

A polyester fleece 1.9 cm. thick weighing 12.5 g/m$^2$ was laid on the back of a pre-coated carpet. Over top of the web was coated a 0.63 cm. thick layer of foamed compound. The carpet, fleece and foam were passed around a laboratory drum laminator at 135° C. for a period of 45 seconds. The crushed foam/fleece backing was set on leaving the drum laminator. Samples of the carpet were then dried and vulcanized in a laboratory hot air circulating over at 150° C. for 20 minutes. The resulting carpet sample had good resilience and lay-flat characteriscs. The backing could be scratched with the point of a ball point pen without significant abrasion or tearing. This is excellent compared to prior art foam backings which tear when scratched with the thumbnail.

EXAMPLE II

The procedure of Example I was repeated except that the base compound has the following formulation:

| | Dry | Wet |
|---|---|---|
| Polysar Latex 431(SB Latex - with higher styrene content than Example I) | 100. | 144.5 |
| Electrolyte | 2.7 | 6.6 |
| Aluminum trihydrate | 125. | 125. |

-continued

| | Dry | Wet |
|---|---|---|
| Thickener - to 5,000 mPa.s on a Brookfield viscometer #5 spindle at 20 rpm | | |
| Cure paste (of Example I) | 5.9 | 11.8 |
| Water - to 76 percent solids. | | |

The polyester fleece was 5 cm. thick and weight 12.5 g/m$^2$. The resulting carpet sample has good resilience and lay-flat properties and excellent abrasion resistance properties.

What is claimed is:

1. A process for preparing a flexible web backed with a dense abrasion resistant, dimensionally stable foam comprising:
   (a) applying substantially uniformly over a planar surface of said web a first layer of material selected from the group consisting of:
      (i) a frothed gellable compound having a density of from 200–1000 g/l based on a latex of a rubbery polymer; and
      (ii) a uniform non-woven fleece having a thickness from about 0.6 to 7.6 cm. and weighing from about 8 to 210 g/m$^2$;
   (b) applying substantially uniformly over said first layer, a second layer of material which is the material not used for the first layer; provided that the compound saturates the fleece and the surface of the web and the dry weight of the compound and web is from 16 to 2100 g/m$^2$;
   (c) compressing said web and said layers to not less than one third of their original thickness of the web and the layers;
   (d) gelling said compound before said fleece significantly expands; and
   (e) drying and vulcanizing said backing.

2. A process for preparing a flexible web backed with a dense abrasion resistant, dimensionally stable foam comprising:
   (a) applying substantially uniformly over a planar surface of said web a first layer of material selected from the group consisting of:
      (i) a frothed gellable compound having a density of from 200–000 g/l based on a latex of a rubbery polymer; and
      (ii) a uniform non-woven fleece having a thickness from about 0.6 to 7.6 cm and weighing from about 8 to 210 g/m$^2$;
   (b) applying substantially uniformly over said first layer, a second layer of material which is the material not used for the first layer; provided that the compound saturates the fleece and the surface of the web and the dry weight of the compound and web is from 16 to 2100 g/m$^2$;
   (c) compressing said web and said layers to not less than one third of their original thickness of the web and the layers;
   (d) gelling said compound before said fleece significantly expands; and
   (e) drying and vulcanizing said backing; and further characterized in that said rubbery polymer is selected from the group consisting of:
   (a) polymers comprising:
      (i) from 15 to 60 weight percent of a $C_{8-12}$ vinyl or vinylidene aromatic monomer which may be unsubstituted or substituted of a $C_{1-4}$ alkyl radical or a chlorine or bromine atom; and (ii) from about 85 to 40 weight percent of a $C_{4-6}$ aliphatic conjugated diolefin which may be unsubstituted or substituted by a chlorine atom;

(b) polymers comprising:

(i) from 5 to 40 weight percent of a $C_{3-8}$ alkenyl nitrile; and (ii) from 95 to 60 weight to a $C_{4-6}$ aliphatic conjugated diolefin.

(c) polymers comprising:

(i) from 70 to 100 weight percent of one or more monomers selected from the group consisting of $C_{1-8}$ alkyl and hydroxyalkyl esters of $C_{3-6}$ ethylenically unsaturated carboxylic acids; and (ii) up to 30 eight percent of a $C_{8-12}$ vinyl or vinylidene aromatic monomer which may be unsubstituted or substituted by a $C_{1-4}$ alkyl radical or a chlorine atom; and (d) polymers comprising:

(i) from 5 to 40 weight percent of a $C_{2-3}$ olefin; and (ii) from 95 to 60 weight percent of one or more monomers selected from the group consisting of $C_{2-8}$ alkenyl or hydroxy alkenyl esters of $C_{1-8}$ saturated carboxylic acids and $C_{1-8}$ alkyl and hydroxyalkyl esters of $C_{3-6}$ ethylenically unsaturated carboxylic acids.

3. A process according to claim 2 where in said compound contains a gelling system selected from the group consisting of:

(a) from about 2 to 10 parts by weight per 100 parts by weight of polymer of a silicon polyether of the formula I $$R'(OC_nH_{2n}) \times OOCNH{-}A{-}CH_2{-}CH_2)_a(R)_bSiO_{\frac{4-a-b}{2}} \quad (I)$$

wherein:

R is a $C_{1-4}$ alkyl radical

R' is a $C_{1-7}$ alkyl radical or a $C_{6-12}$ aryl radical;

A is a $C_{1-7}$ divalent hydrocarbon radical;

a has a value from 0.5 to 1 inclusive;

b has a value from 1.12 to 1.90 inclusive; and the sum of a+b is from 2.02 to 2.40 inclusive;

n is an integer from 2 to 4 inclusive; and x is from 10 to 100, (b) a mixture comprising per 100 parts by weight of polymer 0.05 to 1.0 parts by weight of a silicone ether of formula I in combination with from 4 to 20 parts by weight of an aromatic sulfate of the formula II:

$$R{-}[A{-}SO_3]{-}M \quad (II)$$

wherein:

R is a $C_{8-20}$ alkyl or alkenyl radical;

A is a benzene ring; and

M is an alkali or alkaline earth metal;

(c) from about 1 to 20 parts by weight per 100 parts by weight of polymer of a tertiary ether of the formula III

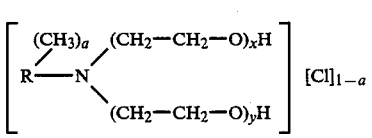

(III)

wherein:

a is zero or one;

x and y are integers and the sum of x+y is from 5 to 30, and

R is a fatty acid radical optionally in combination with:

from 0.5 to 2 parts by weight per 100 parts by weight of polymer of a silicon either of formula I; or from 1 to 10 parts by weight per 100 parts by weight of polymer of an aromatic sulfate of formula II;

(d) from 0.3 to 8 parts by weight per 100 parts by weight of polymer of an ammonium or alkali metal silicofluoride optionally in combination with 6 parts of weight per 100 parts by weight of polymer of one or more members selected from the group consisting of ammonium sulfate, ammonium sulfamates; $C_{1-4}$ alkyl amine sulfates; $C_{1-4}$ alkyl amine sulfamates; and (e) per 100 parts by weight of polymer a sufficient amount of one or more of the following compounds to provide from 0.1 to 6 parts by weight of ammonium ions; ammonia, ammonium hydroxide, ammonium chloride, ammonium salts of $C_{1-6}$ alphatic carboxylic acids; ammonium sulfate; and $C_{1-4}$ alkyl amines together with from 0.1 to 10 parts by weight of a bivalent metal ion.

4. A process, according to claim 3, wherein the first layer is a fleece about 1.2 to 3.8 cm. thick, weighing from 65 to 15 g/m$^2$.

5. A process according to claim 4, therein said fleece is made of one or more fibers selected from the group consisting of:

polyester, polyamide, cellulose, regenerated cellulose, and glass.

6. A process, according to claim 5, wherein the polymer comprises:

from about 20 to 40 weight percent of styrene and from about 80 to 60 weight percent of butadiene.

7. A process, according to claim 4, wherein the compound contains per 100 parts of polymer up to about 150 parts by weight of one or more fillers, selected from the group consisting of calcium carbonate, talc, clay, aluminum trihydrate and barytes, and the compound is frothed to a density from 450 to 500 g/l.

8. A process, according to claim 7, wherein the gelling agent is selected from the group consisting of alkali, metal salts of silicofluorides and binary mixtures of ammonium salts (of $C_{1-6}$ carboxylic acids) ammonium hydroxyide or a $C_{1-4}$ alkyl amine in the presence of a bivalent metal ion.

9. A process, according to claim 8, wherein the gelling agent is present is an amount from 0.5 to 2.5 parts by weight per 100 parts of polymer and is sodium silicofluoride.

10. A process, according to claim 8, wherein the gelling agent is a binary gelling agent, one member being selected from the group ammonia, ammonium hydroxide and ammonium acetate, being present in an amount to provide from 0.3 to 4 parts of ammonia or ammonium ions per 100 parts of polymer and the second member selected from the group consisting zinc oxide and cadmium oxide in an amount from about 1 to 5 parts by weight per 100 parts by weight of polymer.

11. A process, according to claim 9, wherein said compound further comprises from 0.1 to 4.0 parts by weight of ammonium sulfamate per 100 parts by weight of polymer.

12. A process, according to claim 10, wherein said compound further comprises from 0.1 to 4.0 parts by weight of ammonium sulfamate per 100 parts by weight of polymer.

13. A process, according to claim 11, wherein the crushing and gelling stages are conducted simultaneously by passing the web and the two layers around a drum laminator at a temperature from 75° to 150°.

14. A process, according to claim 12, wherein the crushing and gelling stages are conducted simultaneously by passing the web and the two layers around a drum laminator at a temperature from 75° to 150°.

15. A process, according to claim 12, wherein said fleece and foamed compound are crushed; heated from 75° to 150° C. for not more than 10 minutes to gel the compound, then dried and vulcanized in a hot air circulating oven at temperatures from 275° to 325°.

16. A process, according to claim 13, wherein said fleece and foamed compound are crushed; heated from 75° to 150° C. not more than 10 minutes to gel the compound, then dried and vulcanized in a hot air circulating oven at temperatures from 275° to 325°.

* * * * *